US010888862B2

(12) United States Patent
Kellogg et al.

(10) Patent No.: US 10,888,862 B2
(45) Date of Patent: Jan. 12, 2021

(54) ACCELERATION-PRIMED VALVING SYSTEM FOR CENTRIFUGAL MICROFLUIDICS

(71) Applicant: Radisens Diagnostics Limited, Cork (IE)

(72) Inventors: Gregory J. Kellogg, Cambridge, MA (US); David Doolan, Tullamore (IE); Donal Cronin, Mallow (IE)

(73) Assignee: Radisens Diagnostics Limited (IE)

( * ) Notice: Subject to any disclaimer, the term of this patent is extended or adjusted under 35 U.S.C. 154(b) by 0 days.

(21) Appl. No.: 16/194,637

(22) Filed: Nov. 19, 2018

(65) Prior Publication Data

US 2019/0091686 A1 Mar. 28, 2019

Related U.S. Application Data

(63) Continuation-in-part of application No. 14/649,654, filed as application No. PCT/EP2013/075736 on Dec. 5, 2013, now Pat. No. 10,130,947.

(Continued)

(30) Foreign Application Priority Data

Dec. 5, 2012 (EP) ..... 12195761

(51) Int. Cl.
*B01L 3/00* (2006.01)

(52) U.S. Cl.
CPC ..... *B01L 3/502738* (2013.01); *B01L 3/50273* (2013.01); *B01L 2200/06* (2013.01);
(Continued)

(58) Field of Classification Search
CPC .. B01L 3/502738; B01L 3/5027; B01L 3/502; B01L 3/50; B01L 3/00;
(Continued)

(56) References Cited

U.S. PATENT DOCUMENTS 5,693,233 A 12/1997 Schembri
6,063,589 A 5/2000 Kellogg et al.
(Continued)

FOREIGN PATENT DOCUMENTS

WO 2002/074438 9/2002
WO 2012/164552 12/2012

OTHER PUBLICATIONS

PCT Written Opinion for PCT International Patent Application No. PCT/EP2013/075736, dated Jun. 15, 2014 (9 pages).
(Continued)

*Primary Examiner* — Christine T Mui
(74) *Attorney, Agent, or Firm* — K&L Gates LLP

(57) ABSTRACT

A microfluidic system for processing biological samples comprising a holding chamber adapted for holding a fluid and to be rotated on a platform, said holding chamber comprising an outlet through which fluid flow is controlled by an acceleration-primed valve system, wherein the acceleration-primed valve system comprises a capillary valve and an outlet channel. The invention provides a novel valving system, which retains fluids at low angular velocities, removes the need for hydrophilic surfaces, minimises disc real-estate and optimises certain microfluidic processes done in the holding chamber.

15 Claims, 5 Drawing Sheets

Related U.S. Application Data

(60) Provisional application No. 61/733,866, filed on Dec. 5, 2012.

(52) U.S. Cl.
CPC ..... *B01L 2200/0605* (2013.01); *B01L 2200/0652* (2013.01); *B01L 2300/0803* (2013.01); *B01L 2300/087* (2013.01); *B01L 2400/0406* (2013.01); *B01L 2400/0409* (2013.01); *B01L 2400/0688* (2013.01)

(58) Field of Classification Search
CPC ..... B01L 2200/0605; B01L 2200/0652; B01L 2200/06
USPC ..... 422/506, 500, 50
See application file for complete search history.

(56) References Cited

U.S. PATENT DOCUMENTS

| | | | | |
|---|---|---|---|---|
| 6,143,248 | A | 11/2000 | Kellogg et al. | |
| 6,632,399 | B1 | 10/2003 | Kellogg et al. | |
| 2004/0089616 | A1 | 5/2004 | Kellogg et al. | |
| 2004/0209374 | A1* | 10/2004 | Kopf-Sill | B01L 3/502738 436/45 |
| 2007/0003437 | A1 | 1/2007 | Ozaki et al. | |
| 2011/0094600 | A1 | 4/2011 | Bergeron et al. | |
| 2011/0111987 | A1 | 5/2011 | Siegrist et al. | |

OTHER PUBLICATIONS

Gorkin, Robert et al., "Centifugal microfluidics for biomedical applications", The Royal Society of Chemistry, Lab Chip, vol. 10, (2010), pp. 1758-1773.

* cited by examiner

ACCELERATION-PRIMED VALVING SYSTEM FOR CENTRIFUGAL MICROFLUIDICS

CROSS-REFERENCE TO RELATED APPLICATIONS

This is a continuation-in-part of U.S. patent application Ser. No. 14/649,654 filed on Jun. 4, 2015, which is the national phase under 35 U.S.C. § 371 of International Application No. PCT/EP2013/075736 filed on Dec. 5, 2013, which claims priority to and benefit of European Patent Application No. 12195761.7 filed on Dec. 5, 2012 and U.S. Provisional Ser. No. 61/733,866 filed on Dec. 5, 2012, the entire disclosures of each of which are incorporated by reference herein.

FIELD OF THE INVENTION

The invention relates to a new valving system related to a microfluidic disc, apparatus, system and method, for use in clinical diagnostics. In particular the invention relates to an acceleration-primed valving system for use in centrifugal microfluidic platforms.

BACKGROUND

Manual processing to determine the cellular/biological content of various types of samples, and in particular samples that contain living cells, is cost-prohibitive in many applications and is also prone to errors. Automation is also cost-prohibitive in many applications, and is inappropriate as currently practiced—using, for example, liquid handling robots—for applications such as point-of-care or doctor's office analysis. As a result, there is an unmet need to provide sample processing for multiplexed biological assays that is less expensive and less prone to error than current automation or manual processing.

Certain Point-of-Care diagnostic assay systems based on centrifugal microfluidic technology are quite good at performing the necessary integrated sample preparation and assay measurement steps. This centrifugal microfluidic platform with optical detection allows for a variety of assay technologies to be implemented in parallel using a single instrument and disposable suite.

Gating or valving of liquids is a key feature of most centrifugal fluidic platforms, with a variety of different such means existing. These include but not limited to the use of siphoning; passive single-use valves based on surface tension effects (capillary valves, hydrophobic valves); single-use valves based on solid-to-liquid phase transition or melting of a "plug" due to heat applied by a contact heater or light source; and multiple-use valves based on the same principals. Some of these valving mechanisms are well known in the art and have entered the public domain, as described in U.S. Pat. No. 5,693,233, Abaxis.

It is recognized in the art, such as U.S. Pat. No. 6,143,248, Gamera, that manipulation of liquid properties (surface tension, density), material properties (contact angle); and geometric parameters such as the capillary dimensions and configuration of the fluids on the disc; results in well-defined rotational velocities at which capillary pressure is 'defeated' and liquid 'bursts' through passive valves. Using these relationships, a wide range of relevant biological fluids and reagents may be gated at rotational rates from a few hundred RPM (revolutions per minute) to more than 5000 RPM. Siphons function in this way: A chamber is provided by an outlet channel which proceeds radially inward from the chamber and whose path doubles backwards, forming a U, and thus points radially outward. The "U" of the channel is at a radius inward of where the liquid meniscus of the defined volume of liquid which is to be resident in the chamber when the disc is under rotation. In this way, liquid does not proceed through the siphon at high rotational velocities.

As rotational velocity is decreased, capillary action may be used to imbibe the liquid within the siphon. The liquid is drawn past the U, until the liquid meniscus is at a point radially-outward of the position of the radially-inward meniscus of liquid filling the chamber. Upon increased rotational velocity, the meniscus in the channel acts to "pull" liquid from the chamber, just as liquid in a siphon under the influence of gravity may be used to empty a container by first rising above the container surface, and then dropping below it. The container will be emptied completely if the outlet of the channel is below the lowermost portion of the container. In the same way, the siphon on a centrifugal disc can be seen to function.

Siphons are useful because they act in an opposite fashion from capillary valves; fluid will not flow past a siphon at a high rotational speed, unless the velocity is first decreased to allow capillary action to occur. This is especially useful for high velocity separation processes such as separation from plasma from whole blood, where the separation time is minimized if the rotational velocity is maximized. As a result, it is desirable to have valves at various points in the process which will not allow flow, no matter how great the rotational speed.

US 2004/0209374, Abaxis, requires that the location of the inner radial bend of a siphon be located closer to the centre than the holding structure that feeds it. This design relies on a smooth and hydrophilic surface to enable capillary action to defeat the valve. US 2011/0094600, Bergeron et al., refers to standard siphons in the art and introduces a serial siphon valve design.

PCT Patent publication number WO02/074438, assigned to Gyros AB, discloses a microfluidic device that comprises several microchannel structures. A paper published by Gorkin et al 'Centrifugal microfluidics for biomedical applications' Lab on a Chip, Royal Society of Chemistry, col. 10, 28 May 2010, Pages 1758-1773 discloses a centrifugal microfluidic platform for biomedical applications having a siphon having a hydrophilic surface. A problem with siphons described in the art is that liquids cannot be retained within the chamber at low rotational velocities. For example, if the chamber is to be used for an incubation step where slow agitations are required, the meniscus may be drawn by capillary action around the "U" and the chamber emptied upon acceleration of the disc. Similarly, if a detection step is required where the disc must be stationary, the siphon will be defeated.

A further problem is the necessity for capillary action. This typically requires that the surface of the channel be smooth and hydrophilic. The latter is usually accomplished by surface treatment, e.g., plasma etching or deposition of hydrophilic materials. This adds to the costs and complexities of disc manufacture.

It is therefore an object of this invention to provide a valving system for use on a centrifugal microfluidic platform to overcome at least one of the above mentioned problems.

SUMMARY OF THE INVENTION

According to the invention there is provided, as set out in the appended claims, a microfluidic system for processing biological samples comprising: a holding chamber adapted for holding a fluid and to be rotated on a platform, said holding chamber comprising an outlet through which fluid flow is controlled by an acceleration-primed valve system, wherein the acceleration-primed valve system comprises a capillary valve and an outlet channel.

The invention provides a valving system, which retains fluids at low angular velocities, removes the need for hydrophilic surfaces, minimises disc real-estate and optimises certain microfluidic processes done in the holding chamber.

The invention provides an acceleration-primed valve, comprising an acceleration-primed valve and a capillary valve in a particular embodiment with a means for closing and opening the acceleration-primed valve system.

In one embodiment, the holding chamber is dimensioned to have an inner radial wall of radius R1 and outer radial wall of radius R2 from the central axis, and the capillary valve comprises an innermost portion that is radially outward, R3, of the innermost portion of the holding chamber, R1.

In one embodiment, on rotating the platform about the axis at a first speed, the fluid in the holding chamber is pushed against the capillary valve at the radius R3 such that the fluid remains in the holding chamber.

In one embodiment, the platform is adapted to be rotated at a second speed such that the tangential acceleration is chosen such that the induced pressure transient is greater than the release pressure of the capillary valve to enable fluid flow to the outlet channel.

In one embodiment, there is provided means for opening the capillary valve by applying sufficient rotation speed to the platform.

In one embodiment, the outlet channel extends radially inwardly and having an innermost portion that is radially outward of the innermost portion of the holding chamber.

In one embodiment, the outlet channel is dimensioned in a substantially goose-neck type shape.

In one embodiment, the outlet channel comprises a hydrophilic capillary channel adapted to allow the fluid from the holding chamber to flow into the outlet channel via capillary force, when the capillary valve is opened.

In one embodiment, the fluid is allowed to flow into the outlet channel by reducing the angular velocity of the platform to a speed such that the capillary force within the outlet channel is greater than centrifugal force exerted on the holding chamber.

In one embodiment, a second capillary valve is adapted to allow delivery of fluid at a time controlled by an angular velocity high enough to open the output capillary valve.

In one embodiment, the capillary valve is positioned at the innermost portion of the outlet channel.

In one embodiment, the capillary valve is positioned such that upon rotating the platform about the central axis at any speed the capillary valve is innermost to the meniscus of the fluid within the holding chamber when under centrifugal force.

In one embodiment, the acceleration-primed valve is located on the right hand side of the holding chamber, such that a clockwise acceleration of the platform about the central axis opens the acceleration-primed valve.

In one embodiment, the acceleration-primed valve is located on the right hand side of the holding chamber, such that an anti-clockwise acceleration followed by a clockwise deceleration of the platform about the central axis opens the acceleration-primed valve.

In one embodiment, the acceleration-primed valve is located on the left hand side of the holding chamber, such that an anti-clockwise acceleration of the platform about the central axis opens the acceleration-primed valve.

In one embodiment, the acceleration-primed valve is located on the left hand side of the holding chamber, such that a clockwise acceleration followed by an anti-clockwise deceleration of the platform about the central axis opens the acceleration-primed valve.

In one embodiment, the holding chamber comprises a plurality of outlets, wherein each outlet is in fluidic communication with an accelerated-primed valve system, wherein each accelerated-primed valve system is configured to open using the same or a plurality of angular acceleration means.

In another embodiment, there is provided a microfluidic system for processing biological samples comprising: a holding chamber adapted for holding a fluid and to be rotated on a platform, said holding chamber comprising an outlet through which fluid flow is controlled by an acceleration-primed valve system, wherein the acceleration-primed valve system comprises a valve and an outlet channel. In this embodiment, capillary action is not required and the fluid can travel via the output channel if sufficient force generated by acceleration is applied when the platform is rotated.

In one embodiment, the valve is positioned such that upon rotating the platform about the central axis at any speed the valve is innermost to the meniscus of the fluid within the holding chamber when under centrifugal force.

It will be appreciated that centrifugal force can be used to pump once the valve/outlet channel has been primed by a force generated by one or more accelerations.

In a further embodiment of the invention there is provided a microfluidic system for separating plasma within whole blood comprising: Acceleration-Primed Valving System for Centrifugal Microfluidicsa platform coupled to a rotary motor; a plasma holding chamber connected to a cell holding chamber radially outward of it, wherein said connection comprises a plurality of transport capillary channels.

In one embodiment, at least one of the transport capillaries is adapted to dampen down agitated cells in the blood, limiting their resuspension into the plasma holding chamber.

In one embodiment, said structure is used for the separation of any particles in solution.

For cases where the surface is hydrophobic, siphons do not prime as described in the art. This acceleration-primed valve is primed through rapid acceleration, generating a pressure pulse that primes the acceleration-primed valve or defeats capillary valves, based on the following steps: centrifugation to high speed breaks a retaining capillary valve that prevents premature filling of the acceleration-primed valve from the holding chamber at lower rotational speeds. Centrifugation continues at max speed of system without flow of sample to receiving chamber. Reduce RPM: capillary action draws liquid into the acceleration-primed valve, as capillary valve already defeated. Increase RPM: liquid distributed to receiving chamber.

In one aspect, the invention relates to a microfluidic system for processing biological samples. In one embodiment, the microfluidic system comprises a holding chamber adapted for holding a fluid and to be rotated on a platform about a central axis, wherein the holding chamber is dimensioned to have an inner radial wall of radius (R1) and outer radial wall of radius (R2) from the central axis, said holding chamber comprising an outlet through which fluid flow is controlled by an acceleration-primed valve system, wherein the acceleration-primed valve system comprises a capillary valve and an outlet channel, the capillary valve comprising an innermost portion that is radially inward, (R3), of the outermost portion of the holding chamber, (R2), and wherein the capillary valve is primed by a force generated by a tangential acceleration of the platform. In another embodiment, the capillary valve comprises an innermost portion that is radially outward, (R3), of the innermost portion of the holding chamber, (R1). In yet another embodiment, the fluid in the holding chamber is pushed against the capillary valve at the radius (R3) such that the fluid remains in the holding chamber on rotating the platform about the central axis at a first speed. In still another embodiment, the fluid in the holding chamber is pushed against the capillary valve at the radius (R3) such that the fluid remains in the holding chamber and the platform is adapted to be rotated at a second speed such that the tangential acceleration is chosen such that an induced pressure transient is greater than a release pressure of the capillary valve to enable fluid flow to the outlet channel on rotating the platform about the central axis at a first speed. In still yet another embodiment, the capillary valve is opened by applying sufficient rotation speed to the platform.

In one embodiment, the outlet channel extends radially inwardly and having an innermost portion that is radially outward of an innermost portion of the holding chamber. In another embodiment, the outlet channel is dimensioned in a goose-neck type shape. In still another embodiment, the outlet channel comprises a hydrophilic capillary channel adapted to allow the fluid from the holding chamber to flow into the outlet channel via capillary force, when the capillary valve is opened. In yet another embodiment, the fluid is allowed to flow into the outlet channel by reducing an angular velocity of the platform to a speed such that the capillary force within the outlet channel is greater than a centrifugal force exerted on the holding chamber. In still yet another embodiment, the microfluidic system comprises a second capillary valve adapted to allow delivery of the fluid at a time controlled by an angular velocity high enough to open the output capillary valve.

In one embodiment, the capillary valve is positioned at the innermost portion of the outlet channel. In another embodiment, the capillary valve is positioned such that upon rotating the platform about the central axis at any speed the capillary valve is innermost to the meniscus of the fluid within the holding chamber when under centrifugal force. In still another embodiment, the acceleration-primed valve is located on the right hand side of the holding chamber, such that a clockwise acceleration of the platform about the central axis opens the acceleration-primed valve or such that an anti-clockwise acceleration followed by a clockwise deceleration of the platform about the central axis opens the acceleration-primed valve. In yet another embodiment, the acceleration-primed valve is located on the left hand side of the holding chamber, such that an anti-clockwise acceleration of the platform about the central axis opens the acceleration-primed valve or such that a clockwise acceleration followed by an anti-clockwise deceleration of the platform about the central axis opens the acceleration-primed valve. In still yet another embodiment, the holding chamber comprises a plurality of outlets, wherein each outlet is in fluidic communication with an accelerated-primed valve system, wherein each accelerated-primed valve system is configured to open using the same or a plurality of angular acceleration means.

In one embodiment, the microfluidic system for separating plasma within whole blood comprises a platform coupled to a rotary motor; and a plasma holding chamber connected to a cell holding chamber radially outward of the plasma holding chamber, wherein said connection comprises a plurality of transport capillary channels, the plasma holding chamber adapted to be rotated on the platform about a central axis, wherein the plasma holding chamber is dimensioned to have an inner radial wall of radius (R1) and outer radial wall of radius (R2) from the central axis, and wherein the plasma holding chamber further has an output channel connected to an acceleration primed valve, wherein the acceleration-primed valve comprises a valve and an outlet channel, the valve comprising an innermost portion that is radially inward, (R3), of the outermost portion of the holding chamber, (R2), and wherein the valve is primed by a force generated by a tangential acceleration of the platform. In another embodiment at least one of the transport capillaries is adapted to dampen down agitated cells in the blood limiting their re-suspension into the plasma holding chamber. In yet another embodiment, the system is used for the separation of any particles in solution.

In one embodiment, the microfluidic system for processing biological samples comprises a holding chamber adapted for holding a fluid and to be rotated on a platform about a central axis, wherein the holding chamber is dimensioned to have an inner radial wall of radius (R1) and outer radial wall of radius (R2) from the central axis, said holding chamber comprising an outlet through which fluid flow is controlled by an acceleration-primed valve system, wherein the acceleration-primed valve system comprises a valve and an outlet channel, the valve comprising an innermost portion that is radially inward, (R3), of the outermost portion of the holding chamber, (R2), and wherein the valve is primed by a force generated by a tangential acceleration of the platform. In another embodiment, the valve is positioned such that upon rotating the platform about the central axis at any speed the valve is innermost to the meniscus of the fluid within the holding chamber when under centrifugal force.

BRIEF DESCRIPTION OF THE DRAWINGS

The invention will be more clearly understood from the following description of an embodiment thereof, given by way of example only, with reference to the accompanying drawings, in which.

DETAILED DESCRIPTION OF THE INVENTION

Figure 1A:
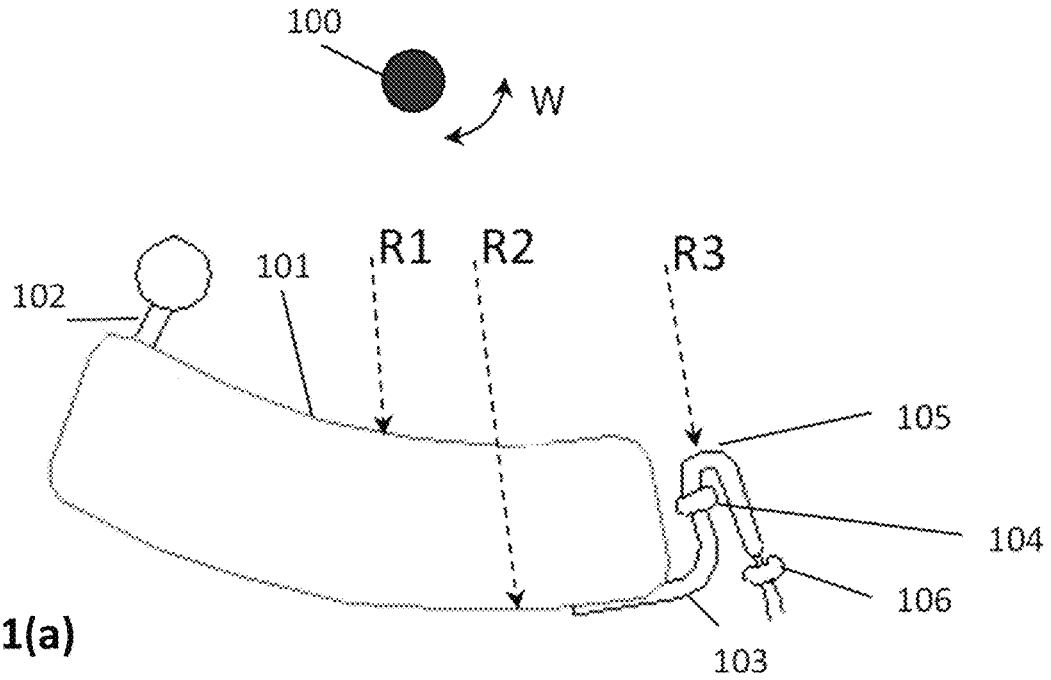
FIGS. 1(*a*) to 1(*c*) present a platform structure with a holding chamber, with fluid flow through an output channel controlled via an acceleration-primed valve according to one embodiment of the invention.
Figure 1B:
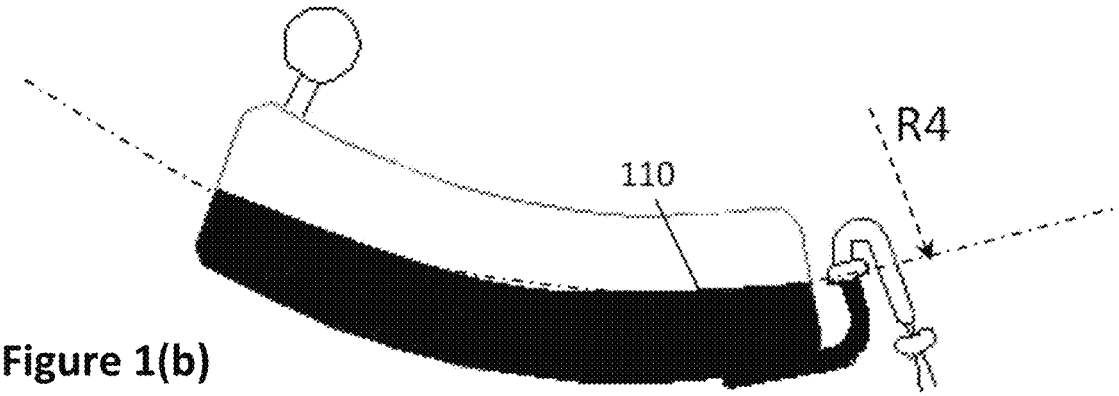
Figure 1C:
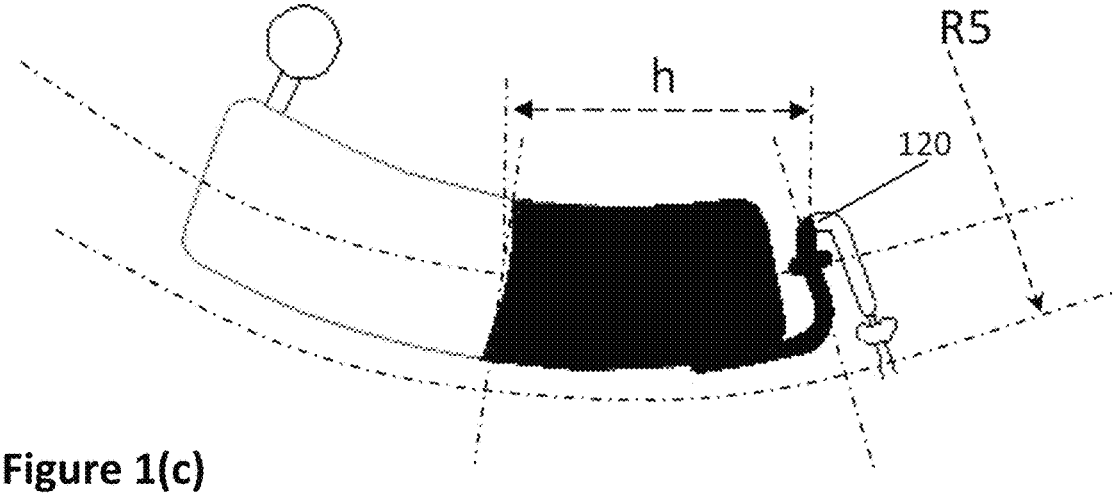

FIGS. 1(*a*) to 1(*c*) present a disc structure which provides an embodiment of an acceleration-primed valve. In FIG. 1(*a*), a disc rotating around a centre or axis 100 with angular velocity W comprises a holding chamber 101 dimensioned to have an inner radial wall of radius R1 and outer radial wall of radius R2, an input channel 102 and output channel 103. An acceleration-primed valve system is illustrated comprising a capillary valve 104 and a goose-neck shaped outlet channel 105, which extends radially inward from the capillary valve, having an innermost portion that is radially outward, R3, of the innermost portion of the holding chamber, R1.

An optional capillary valve 106 at the output of the outlet channel may be used to control the time at which the fluid flow is delivered to the receiving chamber once the acceleration-primed capillary valve 104 is defeated or opened.

In FIG. 1(*b*), the disc rotates at an initial angular velocity W1 in a clockwise direction. As illustrated, a liquid 110 in the holding chamber fills the outlet channel to the capillary valve at radius R4 through centrifugal force, but goes no further, as the centrifugal force generated by the angular velocity W1 has not opened or defeated the capillary valve 104. In other words the acceleration-primed capillary valve remains closed.

In FIG. 1(*c*), a rapid tangential acceleration drives fluid against the wall of the holding chamber nearest the outlet channel, i.e. the fluid is pushed against the side wall creating a fluid column of tangential height, h. The tangential acceleration is chosen such that the induced pressure transient is greater than the release pressure of the capillary valve on the outlet channel. This pressure transient can be approximated by the azimuthal acceleration multiplied by the circumferential extent, R2, of the liquid in the holding chamber and the density of the liquid, just as the pressure at the bottom of a chamber of liquid subject to gravity is gravitational acceleration multiplied by the depth of the chamber multiplied by the liquid density. As a result, the pressure transient defeats or opens the capillary valve and overcomes the goose-neck, to allow liquid to pass through the outlet channel.

This embodiment has the advantage of preventing inadvertent flow through the outlet channel at low angular velocity, thereby increasing the flexibility at which upstream microfluidic processes can be designed/controlled.

In another embodiment, the capillary valve, 104, may be positioned at the innermost portion (the crest of the goose-neck) of the outlet channel, at a radius of approximately R3. The fluid volume within the holding chamber is chosen such that under centrifugal force at any rotational velocity, W, the meniscus of the fluid, R4, will always be radially distal to the capillary valve at R3. A single or multiple tangential accelerations may be applied to defeat the capillary valve and prime the outlet channel until the advancing meniscus, 120, is at a radial position, R5, greater than the distal radial position of the chamber R2. This embodiment allows control of fluid flow across the entire range of angular velocities. The capillary valve will prevent unwanted priming at low angular velocities while the goose-neck prevents priming at high angular velocities. This embodiment works independent of the outlet channel's hydrophobicity/hydrophilicity properties.

In one embodiment, the capillary valve component of the acceleration-primed valve system may be placed distal to the meniscus of the fluid within the holding chamber. Sufficient centrifugal force may be applied to open this capillary valve. In the case of the acceleration-primed system's valve placed distal to the meniscus of the fluid within the holding chamber, either a sufficient centrifugal force or tangential acceleration may prime the acceleration-primed valve. In the case of the acceleration-primed system's valve being placed innermost to the meniscus of the fluid within the holding chamber, a sufficient tangential acceleration may prime the acceleration-primed system's valve.

In one embodiment, the outlet channel may be a hydrophilic capillary channel in which case the fluid from the holding chamber advances via capillary force, once the capillary valve is opened or defeated. This is achieved by reducing the angular velocity of the disc to a speed where capillary force within the outlet channel is greater than centrifugal force exerted. This action primes the outlet channel, where after normal disc rotation may be resumed and the liquid flows through the goose-neck channel.

In another embodiment, an output capillary valve 106 may be placed in the outlet channel to allow delivery of fluid at a time controlled by an angular velocity high enough to defeat or open the output capillary valve.

In another embodiment, the outlet channel may be hydrophobic or sufficiently large to prevent capillary action defeating centrifugal force, since this acceleration-primed valve does not depend on capillary action to siphon liquid through the goose-neck once the capillary valve is defeated or opened.

Figure 2:
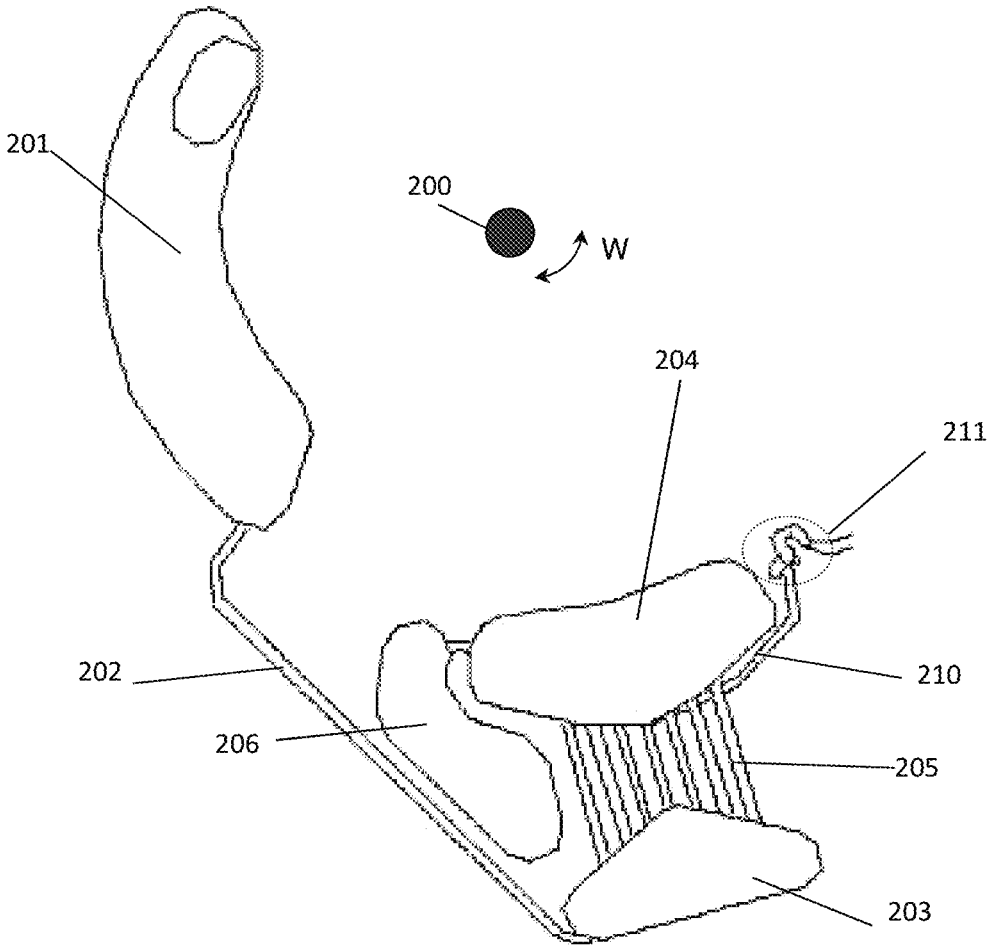
FIG. 2 illustrates an embodiment whereby the holding chamber is a dual-chambered plasma separation structure, with transport capillaries, connecting both chambers, used to dampen the re-suspension of cells into the plasma during the acceleration priming of said valves.

FIG. 2 illustrates an alternative embodiment of the invention in which the holding chamber is designed to perform a plasma separation of whole blood. Here, a disc rotates around a centre 200 with angular velocity W, and comprises an inlet chamber 201, wherein whole blood is applied. Upon rotation at angular velocity W1, the centrifugal force created transports this whole blood through the connecting channel 202 into a plasma separation structure comprising a cell holding chamber 203 connected to a plasma holding chamber 204 via transport capillary channels 205. Excess whole blood overflows into an overflow chamber 206, resulting in a fixed volume amount of whole blood transported to the plasma separation structure. The plasma holding chamber has an output channel 210 connected to an acceleration-primed valve 211, where after the fluid progresses to other downstream processing steps (not shown).

Upon transport of the whole blood into the plasma separation structure, the disc now increases its angular velocity to W2>>W1, whereby the plasma within the whole blood separates from the cell volume, using centrifugation principles understood to those skilled in the art. The size of the plasma holding and cell holding chambers are designed such that the interface between the separated plasma and cells is located at a radial distance within the transport capillaries or cell holding chamber. The radius of this interface depends on the mean cell volume within the whole blood specimen. The time taken by the plasma separation process is much reduced by selecting the angular velocity W2 at rates over 7,000 RPM. At such speeds, there are limits to the practical and cost-effective use of capillary valves for retention of such fluids with channels in the 100-200 um dimension. Hence, the use of an acceleration-primed valve.

In typical plasma separation structures, tangential flow gradients produced by the acceleration profile required to defeat or open such a valve tends to agitate the separated cell volume, thereby resuspending the cells into the plasma. This embodiment improves upon the art, by having two separate structures connected by narrow transport capillaries. The transport capillaries have the effect of damping down the agitated cells, limiting their resuspension into the plasma holding chamber.

Figure 3:
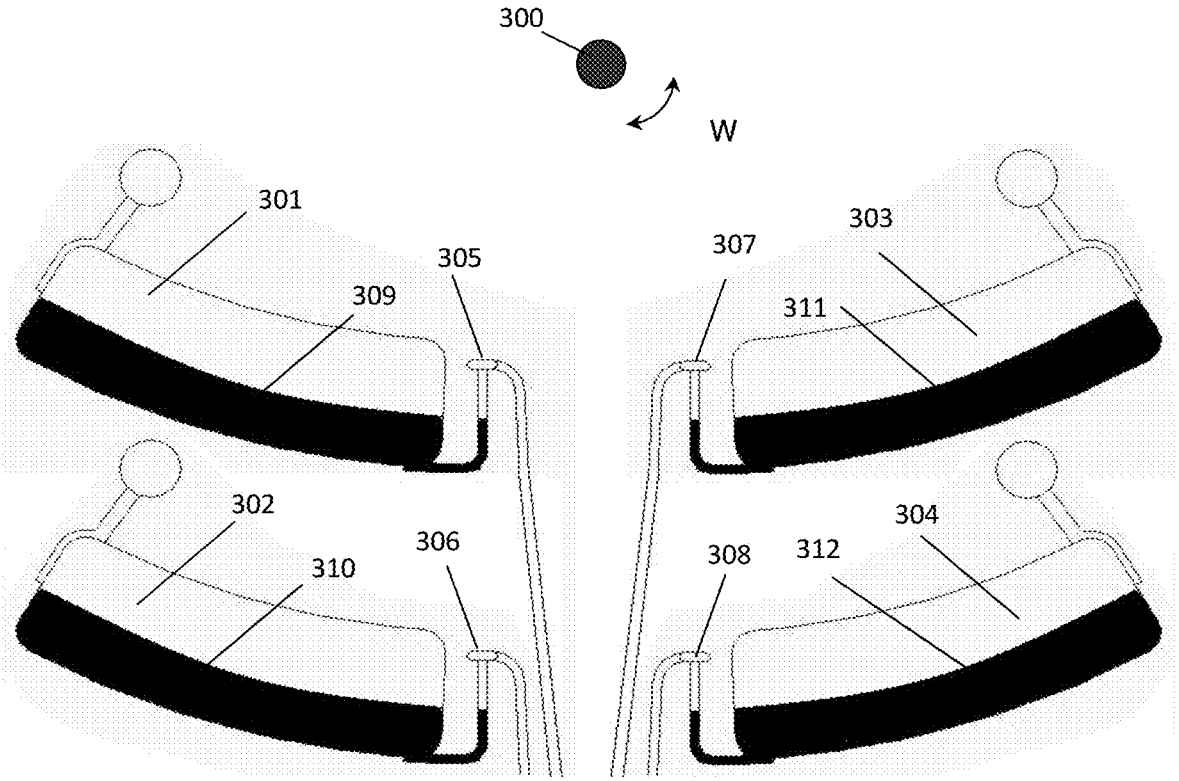
FIG. 3 illustrates an embodiment whereby a plurality of holding chambers are adapted to include acceleration-primed valves located on the left hand side and the right hand side of each holding chamber.

FIG. 3 presents a disc structure which provides embodiments of an acceleration-primed valve. A disc rotating around a centre or axis 300 with angular velocity W, comprises a plurality of holding chambers, 301-304, and outlet channels containing acceleration-primed valves 305-

308. Holding chambers 301-304 contain fluids 309-312, respectively. Holding chambers 302 and 304 are radially distal of chambers 301 and 303. The outlet channels are shaped as goose-neck/siphon and are equipped with capillary valves located innermost to the fluid meniscus contained within the holding chamber, as previously described. The acceleration-primed valves 305 and 306 are positioned to be on the right hand side of holding chambers 301 and 302, respectively. The acceleration-primed valves 307 and 308 are positioned to be on the left hand side of chambers 303 and 304, respectively. When an angular acceleration is applied, fluids within the holding chambers will move in the opposite direction to such angular acceleration. This direction of angular acceleration determines whether the fluid flows through the left hand side or right hand side acceleration-primed valves, under the methods previously described. Therefore, there is a 'handedness' to the positioning and use of the acceleration-primed valves, with respect to the holding chamber.

The magnitude of the tangential acceleration depends on the radial position of the acceleration-primed valves; that is for a constant angular acceleration, the tangential acceleration increases as radial distance increases. In the FIG. 3, when a clockwise angular acceleration is applied, the resulting tangential force will act in a counter-clockwise direction meaning fluids will move to the right hand side of their respective holding chambers. Acceleration-primed valves 305 and 306 will be acted upon as they are positioned on the right hand side of their respective chambers 301 and 302. Acceleration-primed valves 307 and 308 will not be acted upon as they are located on the left hand side of their respective chambers. Acceleration-primed valves 305 and 306 can be designed such that for a given angular acceleration, the pressure transient generated is sufficient to break and prime 306 while 305 remains intact. A subsequent angular acceleration of greater magnitude can then be applied to break and prime 305. Similarly, when a counter-clockwise angular acceleration is applied, the resulting tangential force will act in a clockwise direction meaning fluids will move to the left hand side of their respective holding chambers. The acceleration-primed valves 307 and 308 will now be subjected to a pressure transient which can be designed to break them sequentially or simultaneously. It has not been illustrated but the outlet channels may be directed to a single or multiple chambers for further processing of fluids.

This embodiment has the advantage of controlling fluid delivery from multiple holding chambers at differing radial positions. The bursting pressure of capillary valves can be controlled by fluid properties and capillary dimensions. The tangential acceleration is dependent on the angular acceleration multiplied by the radial distance from the centre of rotation. Therefore, acceleration-primed valves at greater radial distances will subject to larger tangential forces.

This embodiment has the advantage of controlling fluid delivery depending the 'handedness' of the valving system. Unlike centrifugal force which is unidirectional, always acting in the radial direction from innermost to distal, the direction of the force generated from tangential acceleration is dependent on the direction of acceleration. In this way, delivery of fluid through a left or right hand acceleration-primed valve can be controlled by the direction of acceleration.

This embodiment has the advantage of controlling simultaneous or sequential delivery of fluids to a subsequent chamber or chambers. Capillary valve dimensions and fluid properties can be used to design for a desired 'burst pressure'. Chamber dimensions, fluid volume, radial location and angular acceleration can be controlled to define the pressure transient induced. In this way, multiple acceleration-primed valves can be incorporated to burst at defined intervals.

In another embodiment, a plurality of acceleration-primed valves may be connected to either the left hand side or right hand side, or both, of the holding chamber, each with an independent outlet channel. Their respective capillary valve dimensions, goose-neck design and radial location can be controlled to define the pressure transients induced to open each valve. In this way, multiple acceleration-primed valves can control fluid flow from a single holding chamber with each opening at specific angular velocities and/or tangential accelerations.

In the embodiment described above, a valve which is located at the right hand side of a holding chamber is primed by applying a clockwise angular acceleration of sufficient magnitude, such that the resulting tangential force acts in a counter-clockwise direction to move the fluid in its holding chamber to the right hand side to open the valve. However, it should be appreciated that the same effect can be achieved through the application of an angular acceleration followed by a deceleration.

Accordingly, in an alternative embodiment of the invention, a valve located at the right hand side of a holding chamber is primed by applying a counter-clockwise angular acceleration of sufficient magnitude followed by a clockwise deceleration. The resulting tangential force will then act in a counter-clockwise direction to move the fluid in its holding chamber to the right hand side to open the valve.

In the same manner, in an alternative embodiment of the invention a valve located at the left hand side of a holding chamber is primed by applying a clockwise angular acceleration of sufficient magnitude followed by a counter-clockwise deceleration. The resulting tangential force will then act in a clockwise direction, to move the fluid in its holding chamber to the left hand side to open the valve.

Figure 4A:
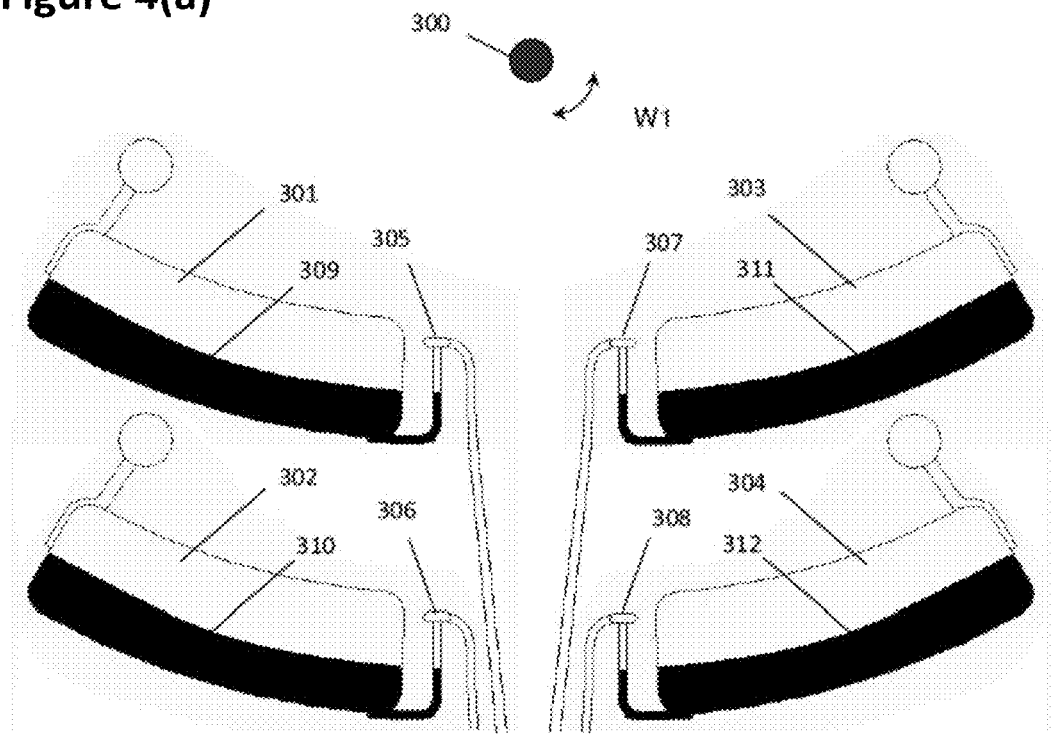
FIGS. 4(*a*) to 4(*c*) illustrate the sequential movement of the liquid in the holding chamber through the accelerated-primed capillary valve 305 shown in the embodiment of FIG. 3.
Figure 4B:
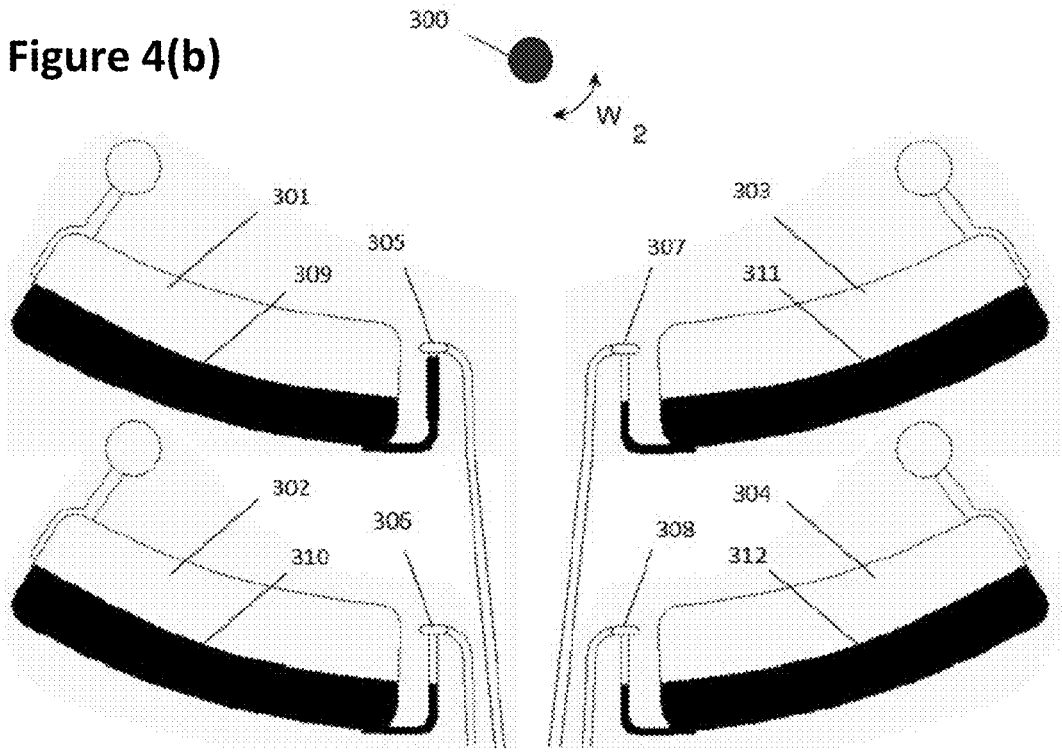
Figure 4C:
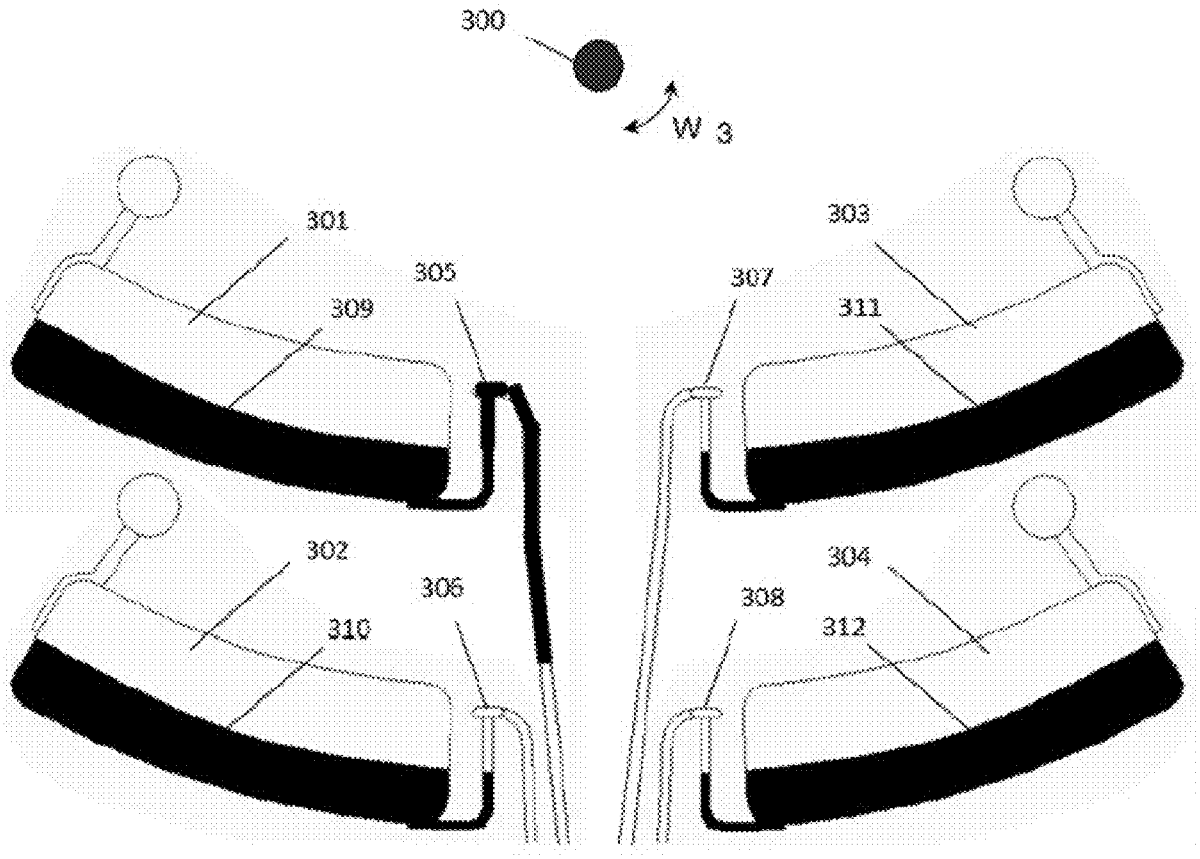

FIGS. 4(*a*) to 4(*c*) illustrate the sequential movement of liquid 309 in the holding chamber 301 through the accelerated-primed capillary valve 305 shown in the embodiment of FIG. 3, that is where the valve 305 is positioned at the innermost portion of the outlet channel (i.e. at the crest of the goose-neck), with the fluid volume in the holding chamber 301 being chosen such that under centrifugal force at any angular velocity W the meniscus of the liquid 309 will always be radially distal to the capillary valve 305.

In FIG. 4(*a*), the disc is rotated at an initial angular acceleration W1 which results in the generation of a tangential force which is not sufficient to defeat the capillary valve 305.

In FIG. 4(*b*), the disc is rotated at a second angular acceleration W2 greater in magnitude than the angular acceleration W1. This causes the liquid 309 in the holding chamber 301 to fill the outlet channel to the capillary valve 305 through tangential force. However, the liquid 309 goes no further, as the tangential force generated by the angular acceleration W2 is not sufficient to defeat the capillary valve 305. In other words, the acceleration-primed capillary valve 305 remains closed.

In FIG. 4(*c*), the disc is rotated at a third angular acceleration W3 greater in magnitude than the second angular acceleration W2. This third angular acceleration is sufficient to subject the acceleration-primed valve 305 to a pressure transient which defeats the valve 305 and overcomes the goose-neck, to allow the liquid 309 to pass through the outlet channel.

The embodiments in the invention described with reference to the drawings comprise a computer apparatus and/or processes performed in a computer apparatus. However, the invention also extends to computer programs, particularly computer programs stored on or in a carrier adapted to bring the invention into practice. The program may be in the form of source code, object code, or a code intermediate source and object code, such as in partially compiled form or in any other form suitable for use in the implementation of the method according to the invention. The carrier may comprise a storage medium such as ROM, e.g. CD ROM, or magnetic recording medium, e.g. a floppy disk or hard disk. The carrier may be an electrical or optical signal which may be transmitted via an electrical or an optical cable or by radio or other means.

In the specification the terms "comprise, comprises, comprised and comprising" or any variation thereof and the terms include, includes, included and including" or any variation thereof are considered to be totally interchangeable and they should all be afforded the widest possible interpretation and vice versa.

The invention is not limited to the embodiments hereinbefore described but may be varied in both construction and detail.

What is claimed is:

1. A microfluidic system for processing biological samples comprising:

a holding chamber adapted for holding a fluid and to be rotated on a platform about a central axis, wherein the holding chamber is dimensioned to have an inner radial wall of radius (R1) and outer radial wall of radius (R2) from the central axis, said holding chamber comprising an outlet through which fluid flow is controlled by an acceleration-primed valve system, wherein the acceleration-primed valve system comprises a capillary valve and an outlet channel, the capillary valve comprising an innermost portion that is radially inward, (R3), of the outermost portion of the holding chamber, (R2), and wherein the capillary valve is primed by a force generated by a tangential acceleration of the platform, wherein the capillary valve is positioned such that upon rotating the platform about the central axis at any speed the capillary valve is innermost to a meniscus of the fluid within the holding chamber when under centrifugal force.

2. The microfluidic system of claim 1, further wherein the capillary valve comprises an innermost portion that is radially outward, (R3), of the innermost portion of the holding chamber, (R1).

3. The microfluidic system of claim 2, wherein on rotating the platform about the central axis at a first speed the fluid in the holding chamber is pushed against the capillary valve at the radius (R3) such that the fluid remains in the holding chamber.

4. The microfluidic system of claim 2, wherein on rotating the platform about the central axis at a first speed the fluid in the holding chamber is pushed against the capillary valve at the radius (R3) such that the fluid remains in the holding chamber and the platform is adapted to be rotated at a second speed such that the tangential acceleration is chosen such that an induced pressure transient is greater than a release pressure of the capillary valve to enable fluid flow to the outlet channel.

5. The microfluidic system of claim 1, wherein the outlet channel extends radially inwardly and having an innermost portion that is radially outward of an innermost portion of the holding chamber.

6. The microfluidic system of claim 1, wherein the outlet channel is dimensioned in a goose-neck type shape.

7. The microfluidic system of claim 1, wherein the outlet channel comprises a hydrophilic capillary channel adapted to allow the fluid from the holding chamber to flow into the outlet channel via capillary force, when the capillary valve is opened.

8. The microfluidic system of claim 7, wherein the fluid is allowed to flow into the outlet channel by reducing an angular velocity of the platform to a speed such that the capillary force within the outlet channel is greater than a centrifugal force exerted on the holding chamber.

9. The microfluidic system of claim 1, comprising a second capillary valve adapted to allow delivery of the fluid at a time controlled by an angular velocity high enough to open the output capillary valve.

10. The microfluidic system of claim 1, wherein the capillary valve is positioned at the innermost portion of the outlet channel.

11. The microfluidic system of claim 1, wherein the acceleration-primed valve is located on the right hand side of the holding chamber, such that a clockwise acceleration of the platform about the central axis opens the acceleration-primed valve or such that an anti-clockwise acceleration followed by a clockwise deceleration of the platform about the central axis opens the acceleration-primed valve.

12. The microfluidic system of claim 1, wherein the acceleration-primed valve is located on the left hand side of the holding chamber, such that an anti-clockwise acceleration of the platform about the central axis opens the acceleration-primed valve or such that a clockwise acceleration followed by an anti-clockwise deceleration of the platform about the central axis opens the acceleration-primed valve.

13. The microfluidic system of claim 1, wherein the holding chamber comprises a plurality of outlets, wherein each outlet is in fluidic communication with an accelerated-primed valve system, wherein each accelerated-primed valve system is configured to open using the same or a plurality of angular acceleration means.

14. A microfluidic system for processing biological samples comprising:

a holding chamber adapted for holding a fluid and to be rotated on a platform about a central axis, wherein the holding chamber is dimensioned to have an inner radial wall of radius (R1) and outer radial wall of radius (R2) from the central axis, said holding chamber comprising an outlet through which fluid flow is controlled by an acceleration-primed valve system, wherein the acceleration-primed valve system comprises a valve and an outlet channel, the valve comprising an innermost portion that is radially inward, (R3), of the outermost portion of the holding chamber, (R2), and wherein the valve is primed by a force generated by a tangential acceleration of the platform, wherein the valve is positioned such that upon rotating the platform about the central axis at any speed the valve is innermost to a meniscus of the fluid within the holding chamber when under centrifugal force.

15. The microfluidic system of claim 1, wherein the outlet channel comprises a hydrophobic capillary channel.

* * * * *